US005387136A

United States Patent [19]

Britton

[11] Patent Number: 5,387,136

[45] Date of Patent: Feb. 7, 1995

[54] CIGARETTE LIGHTER ADAPTER PLUG

[76] Inventor: Glenn A. Britton, P.O. Box 83, Schererville, Ind. 46375

[21] Appl. No.: 143,650

[22] Filed: Nov. 1, 1993

[51] Int. Cl.[6] ..... H01R 17/18

[52] U.S. Cl. ..... 439/668; 439/353; 439/490; 439/638

[58] Field of Search ..... 439/638, 639, 352, 353, 439/34, 668, 490, 522, 700, 824

[56] References Cited

U.S. PATENT DOCUMENTS

| | | | |
|---|---|---|---|
| 2,496,476 | 2/1950 | Kaplan | 439/668 |
| 4,054,352 | 10/1977 | Rudin | 439/638 |
| 4,248,494 | 2/1981 | McDonald et al. | 439/668 |
| 5,007,863 | 4/1991 | Xuan | 439/639 |
| 5,201,677 | 4/1993 | Takayama | 439/668 |
| 5,230,641 | 7/1993 | Wharton | 439/824 |

*Primary Examiner*—Daniel W. Howell

[57] ABSTRACT

An adapter plug for a vehicle's cigarette lighter socket comprising a sleeve and body insertable into the sleeve, the sleeve further comprising a first tube adapted to be coupled to a negative terminal of a vehicle electrical system, a first terminal pin disposed within the first tube, the first terminal pin adapted to be coupled to a positive terminal of a vehicle's electrical system, and means for electrically isolating the first terminal pin from the first tube the body further comprising a second tube adapted to be coupled to a negative terminal of an electrical accessory a second terminal pin disposed within the second tube, the second terminal pin adapted to be coupled to a positive terminal of an electrical accessory and means for electrically isolating the second terminal pin from the second tube means for coupling the first terminal pin to the second terminal pin; and means for coupling the body to the sleeve such that the plug is energized.

4 Claims, 4 Drawing Sheets

CIGARETTE LIGHTER ADAPTER PLUG

BACKGROUND OF THE INVENTION

1. Field of the Invention

The present invention relates to adapter plugs for automobile cigarette lighters and more particularly pertains to a adapter plug which may be used in an automobile's cigarette lighter socket.

2. Description of the Prior Art

The use of cigarette lighter adapter plugs which can be used to power electrical accessories is known in the prior art. More specifically, cigarette lighter adapter plugs heretofore devised and utilized for the purpose of powering electrical accessories are known to consist basically of familiar, expected and obvious structural configurations, notwithstanding the myriad of designs encompassed by the crowded prior art which have been developed for the fulfillment of countless objectives and requirements.

For example, a U.S. Pat. No. Des. 263,951 to Antretter, U.S. Pat. No. 4,988,315 to Wharton, and U.S. Pat. No. 5,131,870 to El-Haj each depict an adapter plug adapted to frictionally engage an adapter sleeve.

Other patents that illustrate components generally related to the present invention are U.S. Pat. No. 5,116,248 to Hiers and U.S. Pat. No. 5,158,484 to Chou.

While these devices fulfill their respective, particular objective and requirements, the aforementioned patents do not describe a cigarette lighter adapter plug adapted to maintain frictional contact with its adapter sleeve while simultaneously being mechanically coupled thereto, thereby increasing the reliability of the electrical connection.

In this respect, the cigarette lighter adapter plug according to the present invention substantially departs from the conventional concepts and designs of the prior art, and in doing so provides an apparatus primarily developed for the purpose of powering electrical accessories.

Therefore, it can be appreciated that there exists a continuing need for an improved cigarette lighter adapter plug which can be used to power electrical accessories. In this regard, the present invention substantially fulfills this need.

SUMMARY OF THE INVENTION

In the view of the foregoing disadvantages inherent in the known types of cigarette lighter adapter plugs for powering electrical accessories now present in the prior art, the present invention provides and improved cigarette lighter adapter plug wherein the same can be utilized for powering electrical accessories. As such, the general purpose of the present invention, which will be described subsequently in greater detail, is to provide a new and improved cigarette lighter adapter plug for powering electrical accessories which has all the advantages of the prior art and none of the disadvantages.

To attain this, the present invention essentially comprises a sleeve and body insertable into the sleeve, the sleeve further comprising a first tube adapted to be coupled to a negative terminal of a vehicle electrical system, a first terminal pin disposed within the first tube, the first terminal pin adapted to be coupled to a positive terminal of a vehicle's electrical system, and means for electrically isolating the first terminal pin from the first tube the body further comprising a second tube adapted to be coupled to a negative terminal of an electrical accessory a second terminal pin disposed within the second tube, the second terminal pin adapted to be coupled to a positive terminal of an electrical accessory and means for electrically isolating the second terminal pin from the second tube means for coupling the first terminal pin to the second terminal pin; and means for coupling the body to the sleeve such that the plug is energized.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved cigarette lighter adapter plug which has all the advantages of the prior art and none of the disadvantages.

It is another object of the present invention to provide a new and improved cigarette lighter adapter plug which may be easily and efficiently manufactured and marketed.

It is a further object of the present invention to provide a new and improved cigarette lighter adapter plug which is of durable and reliable construction.

An even further object of the present invention is to provide a new and improved cigarette lighter adapter plug which is susceptible of a low cost of manufacture with regard to both materials and labor, and which accordingly is then susceptible of low prices of sale to the consuming public, thereby making such cigarette lighter adapter plugs economically available to the buying public.

Still yet another object of the present invention is to provide a new and improved cigarette lighter adapter plug which provides in the apparatuses and methods of the prior art some of the advantages thereof, while simultaneously overcoming some of the disadvantages normally associated therewith.

Still another object of the present invention is to provide a new and improved cigarette lighter adapter plug that maintains frictional contact with its adapter sleeve while simultaneously being mechanically coupled thereto, thereby increasing the reliability of the electrical connection.

Yet another object of the present invention is to provide a new and improved cigarette lighter adapter plug that maintains a connection with its adapter sleeve even when bumped, jarred, or vibrated.

Yet another object of the present invention is to provide a new and improved cigarette adapter plug that is insertable into the cigarette lighter socket of an automobile.

Yet another object of the present invention is to provide a new and improved cigarette adapter plug whereby heat buildup within the plug is minimized.

Yet another object of the present invention is to provide a new and improved cigarette adapter plug that is adapted to energize a variety of electrical appliances at different power ratings, such as a television set or a hair dryer.

Even still another object of the present invention is to provide an adapter plug for an automobile's cigarette lighter socket comprising a body insertable into a sleeve, the sleeve further comprising a first tube adapted to be coupled to a negative terminal of a vehicle's electrical system, a first terminal pin disposed within the first tube, the first terminal pin adapted to be coupled to a positive terminal of a vehicle's electrical system, and means for electrically isolating the first terminal pin from the first tube, the body further comprising a second tube adapted to be coupled to a negative terminal of an electrical accessory, a second terminal pin disposed within the second tube, the second terminal pin adapted to be coupled to a positive terminal of an electrical accessory, and means for electrically isolating the second terminal pin from the second tube, means for coupling the first terminal pin to the second terminal pin, and means for coupling the body to the sleeve such that the plug is energized.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
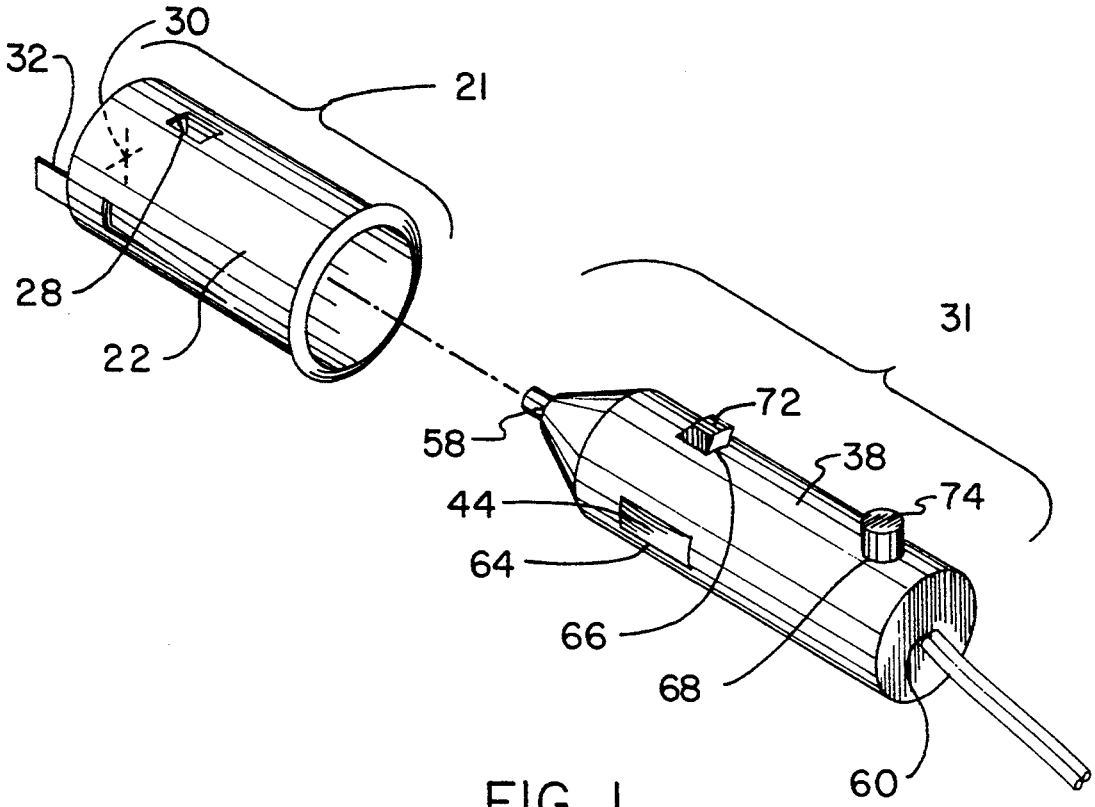
FIG. 1 is a perspective view of the cigarette lighter adapter plug constructed in accordance with the principles of the present invention.
Figure 2:
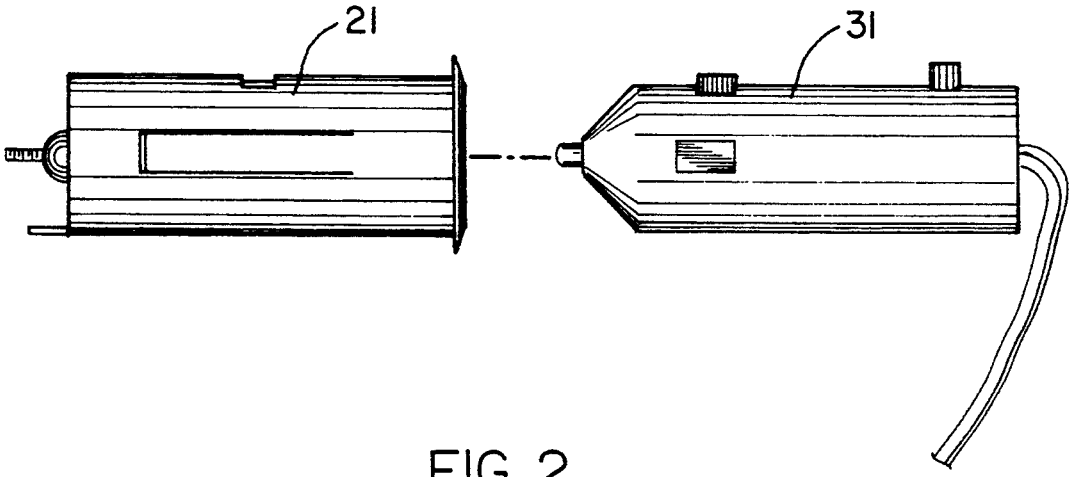
FIG. 2 is a side elevational view of the cigarette lighter adapter plug of FIG. 1.
Figure 3:
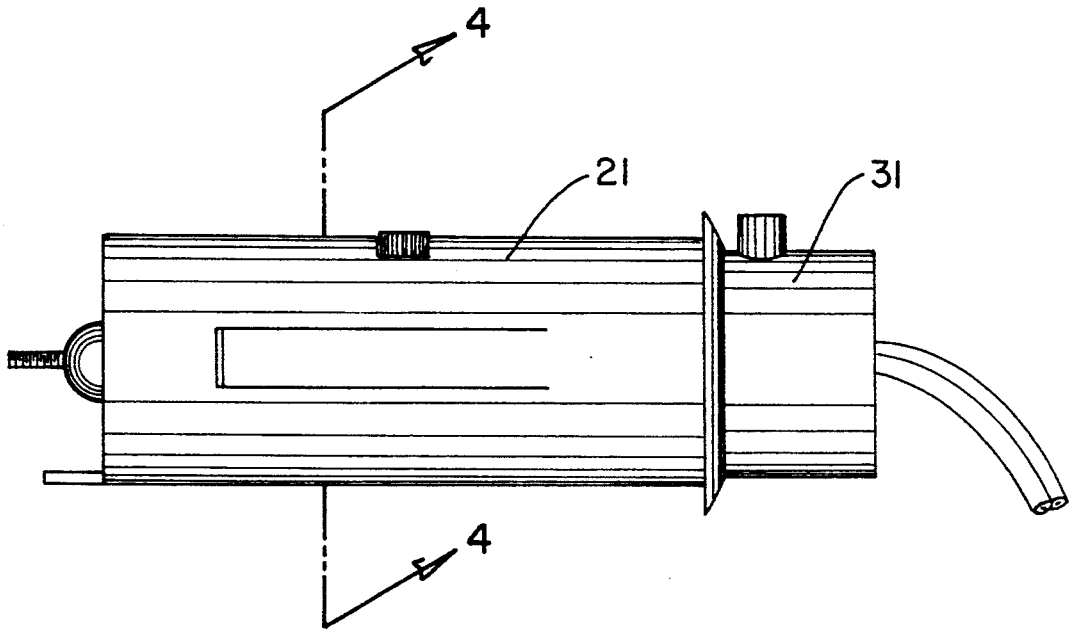
FIG. 3 is a side elevational view of the cigarette lighter adapter plug of FIG. 1 shown in a coupled configuration.
Figure 4:
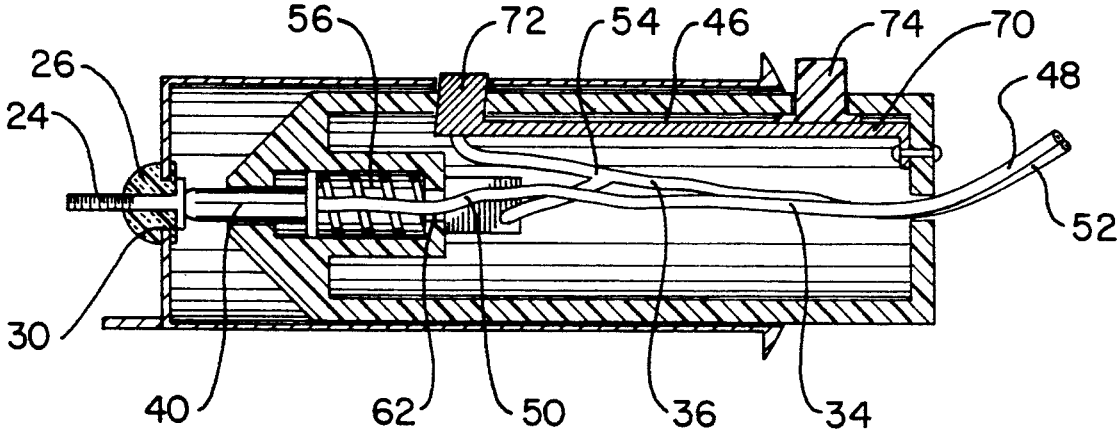
FIG. 4 is a cross sectional view of the cigarette lighter adapter of the FIG. 3 embodiment taken along the line 4—4 of FIG. 3.

With reference now to the drawings, and in particular, to FIG. 1 through 8 thereof, a new and improved cigarette lighter adapter plug embodying the principles and concepts of the present invention and generally designated by the reference number 10 will be described.

The cigarette lighter adapter plug 10 comprises a body insertable into a sleeve 21. The sleeve further comprises a first tube 22, a first terminal pin 24, and an insulation detent 26. The first tube has a sealed bottom end, an open top end, and a locking hole 28 disposed thereon. The sealed bottom end has a socket 30 hole disposed thereon and a terminal peg 32 coupled thereto. The terminal peg is adapted to be coupled to a negative terminal of a vehicle's electrical system. The top end of the first tube is adapted to receive the body 31. The locking hole 28 is adapted to receive a locking pin 72 of the body. The first terminal pin 24 is disposed in the socket hole 30 of the first tube 22. The first terminal pin is adapted to be coupled to a positive terminal of a vehicle's electrical system. The first terminal pin is further adapted to be coupled to a second terminal pin 40 of the body 31. An insulation detent 26 couples the first terminal pin 24 to the first tube 22. The insulation detent electrically isolates the first terminal pin from the first tube.

The body 31 further comprises a positive wire 34, a negative wire 36, a second tube 38, a second terminal pin 40, a spring 42, a contact pin 44, and a switch 46. The positive wire 34 has a first end 48 and a second end 50. The first end of the positive wire is adapted to be coupled to a positive terminal of an electrical accessory. The negative wire 36 has a first end 52 and a second end 54. The first end of the negative wire is adapted to be coupled to a negative terminal of an electrical accessory.

The second tube 38 has a conically sealed bottom end, a sealed top end, and a cavity 56 disposed therein. The bottom end of the of the second tube has a tip hole 58 disposed thereon. The tip hole is adapted to receive a second terminal pin 40. The top end of the cavity has a wire hole 60 disposed thereon. The second end 50 of the positive wire and second end 54 of the negative wire are disposed through the wire hole 60 and into the second tube 38. The cavity is adapted to receive a spring 42 and a second terminal pin 40. The cavity has an sealed top end and an open bottom end. The bottom end of the cavity is aligned with the tip hole 58. The sealed top end of the cavity has a cavity hole 62 disposed thereon. The second end 50 of the positive wire is disposed through the cavity hole. The second tube also has a contact hole 64, a pin hole 66, and a button hole 68 disposed thereon. The contact hole 64 is adapted for receipt of a contact pin 44. The pin hole 66 is adapted for receipt of a locking pin 72. The button hole 68 is adapted for receipt of a push button 74.

The second terminal pin 40 is slidably disposed within the cavity 56 such that it extends from the cavity through the tip hole 58. The second terminal pin is coupled to the second end 50 of the positive wire and adapted to contact the first terminal pin 40. The spring 42 is slidably disposed within the cavity 56 and adapted for urging the second terminal pin through the tip hole 58 to couple with the first terminal pin 40.

The contact pin 44 is coupled to the second tube 38 and second end 54 of the negative wire. The contact pin is disposed through the contact hole 64 such that it projects beyond the periphery of the body 31 in order to frictionally engage the sleeve 21 and resist movement of the body within the sleeve.

The switch 46 is disposed within the second tube 38 and further comprises a flexible metal strip 70, a metal locking pin 72, and a push button 74. The flexible metal strip has a first end and a second end. The first end of the strip is coupled to the top end of the second tube 38. The metal locking pin 72 is coupled to the metal strip and the second end 54 of the negative wire. The locking pin is disposed through the pin hole such that it projects beyond the periphery of the body 31 when at a rest position. The push button 74 is coupled to the metal strip 70. The push button is disposed through the button hole 68 such that it projects beyond the periphery of the body 31. When the push button 74 is depressed, the locking pin 72 retracts to a position essentially equal with the periphery of the body 31, thereby allowing the body to be inserted into or removed from the sleeve 21. When the body is inserted into the sleeve and the push button is released, the locking pin returns to the rest position through the locking hole of the sleeve, coupling the body to the sleeve such that the plug 10 is energized.

Figure 5:
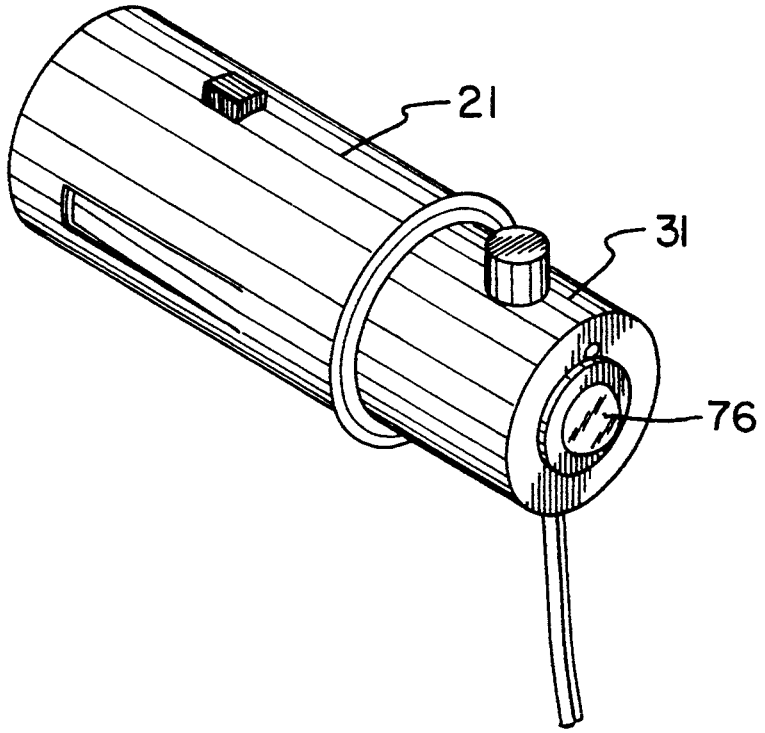
FIG. 5 is a perspective view of a cigarette lighter adapter plug constructed in accordance with an alternate embodiment of the invention.
Figure 6:
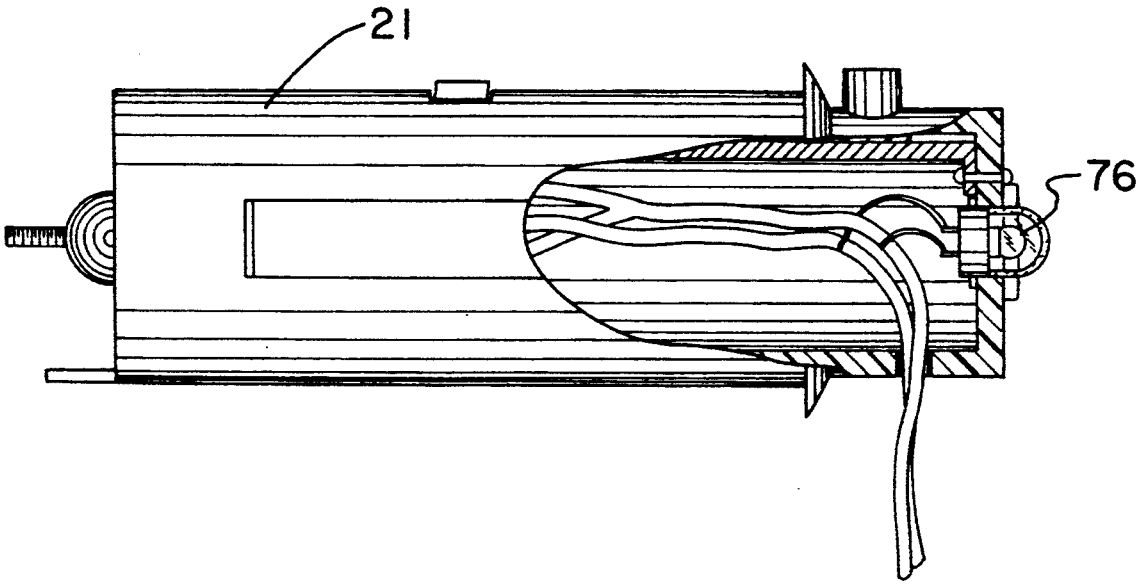
FIG. 6 is a cross sectional view of the FIG. 5 embodiment.

A second embodiment of the present invention is shown in FIGS. 5 and 6 and comprises substantially all of the features of the first embodiment and further includes a light source 76 connected to the body 31. The light source is adapted to be electrically energized when the body is 31 coupled within the sleeve 21. The light source is further adapted to provide a user an indication of the goodness of the electrical connection between the sleeve and body.

Figure 7:
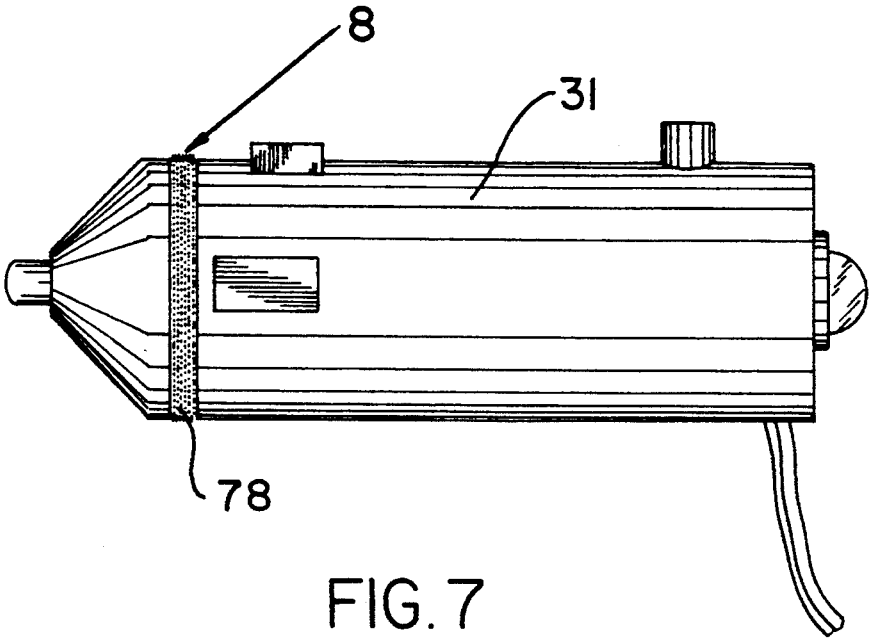
FIG. 7 is a side elevational view of a cigarette lighter adapter plug constructed in accordance with a further alternate embodiment of the invention.
Figure 8:
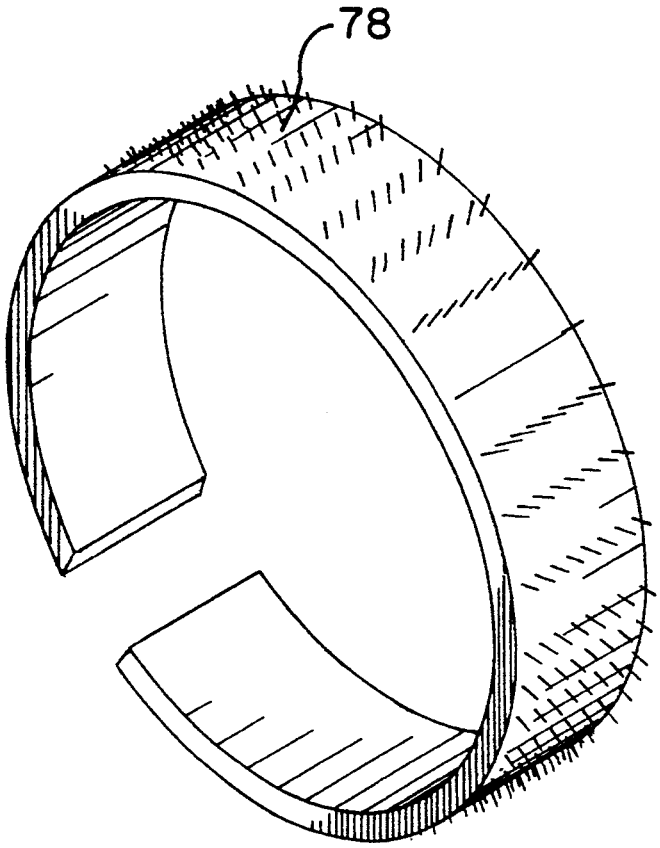
FIG. 8 is an enlarged view of the brush region of the cigarette lighter adapter plug of FIG. 7.

A third embodiment of the present invention is shown in FIGS. 7 and 8 and comprises substantially all of the features of the first embodiment. It further includes a cleaning brush 78 attached about the periphery of the body 31. The brush is adapted to clean the interior of the sleeve 21 each time the sleeve and body are connected and disconnected such that a good electrical connection is maintained.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. An adapter plug for an automobile cigarette lighter socket comprising:

a sleeve with a body insertable into the sleeve, the sleeve further comprising:

(i) a first tube having a sealed bottom end, an open top end, and a locking hole disposed thereon, the sealed bottom end having a socket hole disposed thereon and a terminal peg coupled thereto, the terminal peg adapted to be coupled to a negative terminal of a vehicle electrical system, the top end adapted to receive the body, and the locking hole adapted to receive a locking pin of the body;

(ii) a first terminal pin disposed in the socket hole of the first tube, the first terminal pin adapted to be coupled to a positive terminal of a vehicle electrical system and adapted to be coupled to a second terminal pin of the body;

(iii) an insulation detent coupling the first terminal pin to the first tube and electrically isolating the first terminal pin from the first tube;

the body further comprising:

(i) a positive wire having a first end and a second end, the first end adapted to be coupled to a positive terminal of an electrical accessory;

(ii) a negative wire having a first end and a second end, the first end adapted to be coupled to a negative terminal of an electrical accessory;

(iii) a second tube having a conically sealed bottom end, a sealed top end, and a cavity disposed therein, the sealed bottom end having a tip hole disposed thereon with the tip hole adapted to receive a second terminal pin, the top end having a wire hole disposed thereon, with the second end of the positive wire and second end of the negative wire disposed therethrough, and the cavity adapted to receive a spring and a second terminal pin, the cavity having a sealed top end and an open bottom end, the bottom end aligned with the tip hole, the sealed top end having a cavity hole disposed thereon, with the second end of the positive wire disposed therethrough, the second tube further having a contact hole, a pin hole, and a button hole disposed thereon, the contact hole adapted for receipt of a contact pin, the pin hole adapted for receipt of a locking pin, and the button hole adapted for receipt of a push button;

(iv) a second terminal pin slidably disposed within the cavity such that it extends from the cavity through the tip hole, the second terminal pin coupled to the second end of the positive wire and adapted to contact the first terminal pin of the sleeve;

(v) a spring slidably disposed within the cavity and adapted for urging the second terminal pin through the tip hole to couple with the first terminal pin;

(vi) a contact pin coupled to the second tube and second end of the negative wire, the contact pin disposed through the contact hole such that it projects beyond the periphery of the body in order to frictionally engage the sleeve and resist movement of the body within the sleeve; and (vii) a switch disposed within the second tube, the switch further comprising:

(a) a flexible metal strip having a first end and a second end, the first end of the strip coupled to the top end of the second tube;

(b) a metal locking pin coupled to the metal strip and the second end of the negative wire, the locking pin disposed through the pin hole such that it projects beyond the periphery of the body when at a rest position; and (c) a push button coupled to the metal strip, the push button disposed through the button hole such that it projects beyond the periphery of the body, whereby when the push button is depressed the locking pin retracts to a position essentially equal with the periphery of the body, thereby allowing the body to be inserted into and removed from the sleeve, such that when the body is inserted into the sleeve and push button is released, the locking pin returns to the rest position through the locking hole of the sleeve, coupling the body to the sleeve such that the plug is energized.

2. An adapter plug for an automobile cigarette lighter socket comprising:

a sleeve and body insertable into the sleeve, the sleeve further comprising a first tube adapted to be coupled to a negative terminal of a vehicle electrical system, a first terminal pin disposed within the first tube, the first terminal pin adapted to be coupled to a positive terminal of a vehicle's electrical system, and means for electrically isolating the first terminal pin from the first tube;

the body further comprising a second tube adapted to be coupled to a negative terminal of an electrical accessory a second terminal pin disposed within the second tube, the second terminal pin adapted to be coupled to a positive terminal of an electrical accessory and means for electrically isolating the second terminal pin from the second tube;

means for coupling the first terminal pin to the second terminal pin; and means for coupling the body to the sleeve such that the plug is energized.

3. The device as set forth in claim 2 further including a light source connected to the second tube, the light source adapted to be electrically energized when the body is coupled within the sleeve, the light source further adapted to provide a user an indication of the goodness of the electrical connection between the sleeve and body.

4. The device as set forth in claim 2 further including a cleaning brush attached about the periphery of the body, the brush adapted to clean the interior of the sleeve each time the sleeve and body are connected.

* * * * *